United States Patent [19]

Nitzsche et al.

[11] Patent Number: 4,461,053

[45] Date of Patent: Jul. 24, 1984

[54] MULTIPLE PART TOOTHBRUSH HAVING AN EXCHANGEABLE BRUSH HEAD

[76] Inventors: Klaus Nitzsche, Am Ludwigsplatz; Ludwig Lang; Ortulf G. Lang, both of Rodinghweg 3, all of 61 Darmstadt, Fed. Rep. of Germany

[21] Appl. No.: 379,675

[22] Filed: May 19, 1982

[30] Foreign Application Priority Data

Jan. 13, 1982 [DE] Fed. Rep. of Germany ..... 3200681

[51] Int. Cl.[3] ..... A46B 9/04

[52] U.S. Cl. ..... 15/172; 15/176; 15/145

[58] Field of Search ..... 15/167 R, 176, 143 R, 15/145, 172, 144 R

[56] References Cited

U.S. PATENT DOCUMENTS

| | | | |
|---|---|---|---|
| 1,942,931 | 1/1934 | McWhirter | 15/176 |
| 2,090,144 | 8/1937 | Palimeri et al. | 15/176 |
| 2,175,278 | 10/1939 | Orebaugh | 15/176 |
| 2,517,045 | 8/1950 | Soule | 15/176 |
| 3,059,262 | 10/1962 | Marschner | 15/145 X |
| 3,369,265 | 2/1968 | Halberstadt et al. | 15/176 X |

FOREIGN PATENT DOCUMENTS

| | | | |
|---|---|---|---|
| 23807 | 10/1911 | United Kingdom | 15/176 |
| 216355 | 5/1924 | United Kingdom | 15/176 |

*Primary Examiner*—Peter Feldman

*Attorney, Agent, or Firm*—Flynn, Thiel, Boutell & Tanis

[57] ABSTRACT

A multiple part toothbrush includes a handle stem having a connecting part projecting outwardly from one end thereof and extending in a direction which forms an angle of about 7° with respect to the handle stem. A brush head has a cavity therein, the connecting part being snugly receivable within the cavity to effect a removable mounting of the brush head on the handle stem. The connecting part can be inserted into the brush head cavity with either of two different orientations, whereby two different orientations of the plane defined by the bristle ends with respect to the handle stem are possible.

11 Claims, 15 Drawing Figures

MULTIPLE PART TOOTHBRUSH HAVING AN EXCHANGEABLE BRUSH HEAD

FIELD OF THE INVENTION

This invention relates to a multiple part toothbrush and, more particularly, to a multiple part toothbrush having an exchangeable brush head, the brush head being exchangeable, for example, with brush heads having bristles of different stiffness.

BACKGROUND OF THE INVENTION

Multiple part toothbrushes have already been developed, for example the multiple part toothbrush disclosed in copending U.S. Ser. No. 256,764, filed Apr. 23, 1981 and entitled "Toothbrush", now abandoned. However, certain desirable structural characteristics were not present in these known multiple part toothbrushes, including (1) a composite construction, such as plastic and metal, (2) a rigid, metallic connecting member designed with close tolerances, (3) a springy, metallic connecting member designed with close tolerances, (4) the definition of precise tolerance limits for functionally important dimensions to facilitate satisfactory and global use of a multiple part toothbrush despite atmospheric and weather influences like sun, moisture and thermal stresses, in other words to ensure the accuracy of size of certain dimensions of the multiple part toothbrush, and (5) the provision of an angle in the connecting members so that by simply changing the orientation of the brush head, two contact planes of the bristle ends are possible with respect to the handle and thus with respect to the set of teeth of the user, which contact planes are favorable for proper tooth care.

A toothbrush should also conform to the latest findings regarding proper dental care. These findings support the desirability, among other things, of (1) periodic changing of the brush head, (2) use of a brush head having the best type of bristles and an optimum arrangement of the bristles on the brush head, (3) use of bristles of various stiffnesses, and (4) the ability to adjust the surface defined by the bristle ends and the relative position of the brush head with respect to the surfaces of the teeth of a user.

A further object of the invention is the provision of a toothbrush having an aesthetically appealing and economical shape, the design of the brush head being such that injury during use of the toothbrush is avoided and a secure retention of the brush head on the handle is assured.

A further object of the invention is the provision of a multiple part toothbrush of composite construction having a handle and brush head preferably made of plastic and a metal connecting member therefor which assures a secure and tight interconnection thereof under a wide range of weather conditions, including temperatures from approximately −20° C. to +40° C.

A further object of the invention is the provision of a multi-part toothbrush having a selection of colors for the handle and brush head, which colors appeal to the aesthetic taste of the user or to the tastes of people of a given country.

SUMMARY OF THE INVENTION

The objects and purposes of the invention are met by providing a multiple part toothbrush which includes a handle stem having a connecting part projecting outwardly from an end thereof and arranged at a small angle with respect to the longitudinal axis of the stem. A brush head has a cavity therein, the connecting part being snugly receivable within the cavity to removably mount the brush part on the handle stem. The brush head can be mounted on the handle stem with at least two different orientations, whereby two different orientations of the plane defined by the bristle ends with respect to the handle stem are possible.

In one preferred embodiment, the connecting member is a rigid, metallic member manufactured to close tolerances and having a serrated extension which is embedded in the handle stem. In another preferred embodiment, the connecting member is a loop of spring wire, the ends of which are adjacent, have a plurality of small spurs thereon, and are embedded in the handle stem. The spring wire connecting member preferably has a curved offset portion.

BRIEF DESCRIPTION OF THE DRAWINGS

Although there are many possible ways to construct a multiple part toothbrush with the characteristics of the invention, a preferred design is discussed in greater detail in connection with the drawings, in which.

DETAILED DESCRIPTION

During manufacture of the structural parts of a multiple part toothbrush with the characteristics of the invention, precise tolerances must be maintained, and some preferred tolerances are set forth herein.

Figure 1:
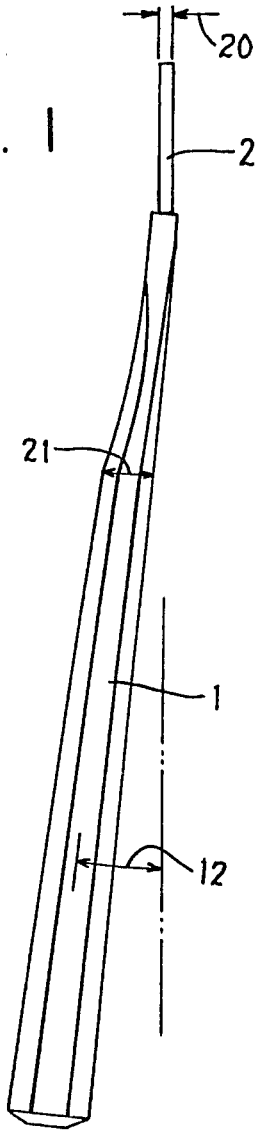
FIG. 1 and 2 are respectively side and front views of a handle of a toothbrush embodying the invention.
Figure 2:
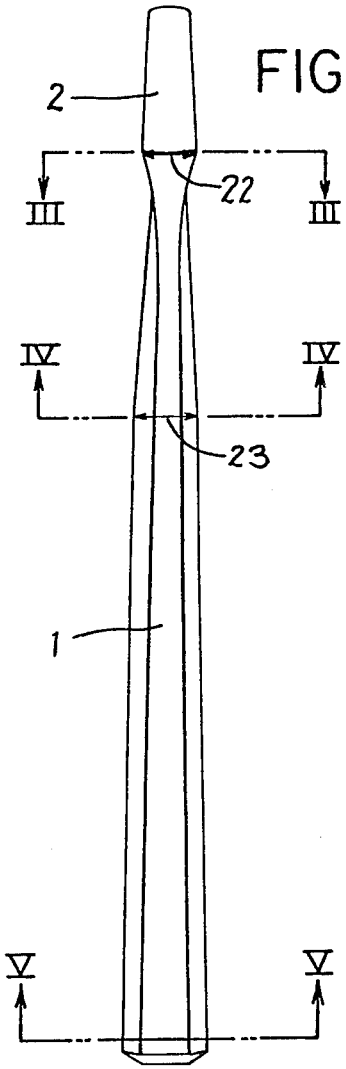
Figure 3:
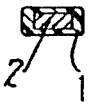
FIG. 3 to 5 are sectional views of the stem of the handle of FIG. 1 taken along the lines III—III, IV—IV and V—V, respectively, of FIG. 2.
Figure 4:
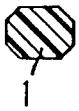
Figure 5:
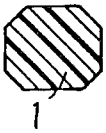

FIGS. 1 to 5 illustrate a toothbrush handle which includes a stem 1 in an advantageous and handy shape, as shown by the sectional views of FIGS. 3 to 5. A rigid, tongue-shaped and preferably metallic connecting member 2 is fixedly mounted in the stem 1 so as to define a structural unit. The handle 1 and 2 could be manufactured entirely of metal, for example of zinc or die cast aluminum and for reasons of weight would be constructed hollow in such case. This would have the advantage of saving plastic parts in comparison with a conventional plastic toothbrush.

Referring to FIGS. 1 and 2, the dimensions 20, 21, 22 and 23 preferably have respective tolerances of +0.0, −0.02 mm; +0.0, −0.03mm; +0.0, −0.05 mm; and +0.0, −0.3 mm.

FIGS. 6 to 9 illustrate, for a composite construction of the handle, such a plastic stem 1 and metal connecting member 2, rigid, metallic, platelike connecting member 3. The connecting member 3 has a serrated extension 4 thereon which is embedded in the plastic stem 1 during assembly.

Figure 6:
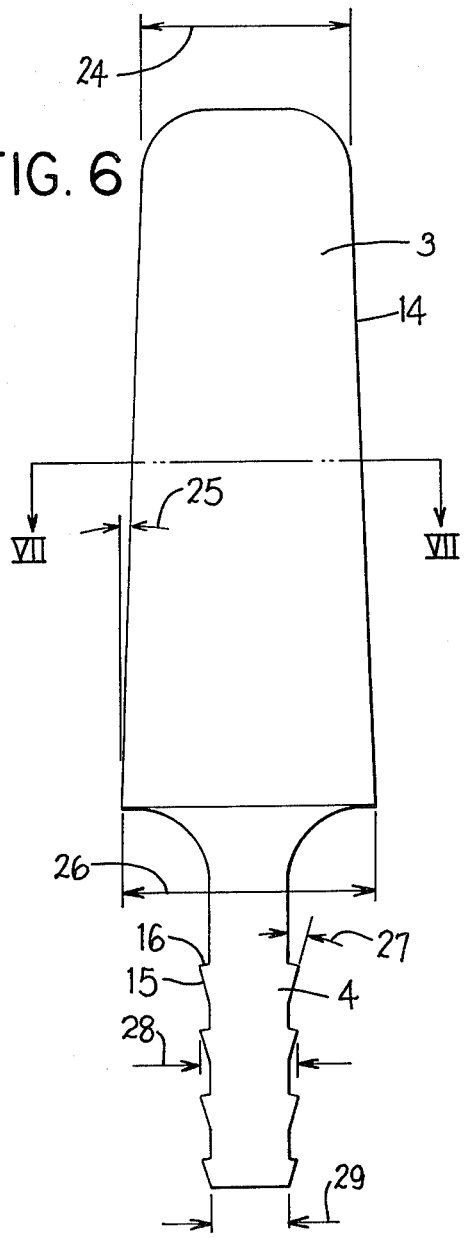
FIG. 6 is a front view of a connecting member which is a component of the handle of FIG. 1, is of rigid construction, and is made according to close tolerances.
Figure 8:
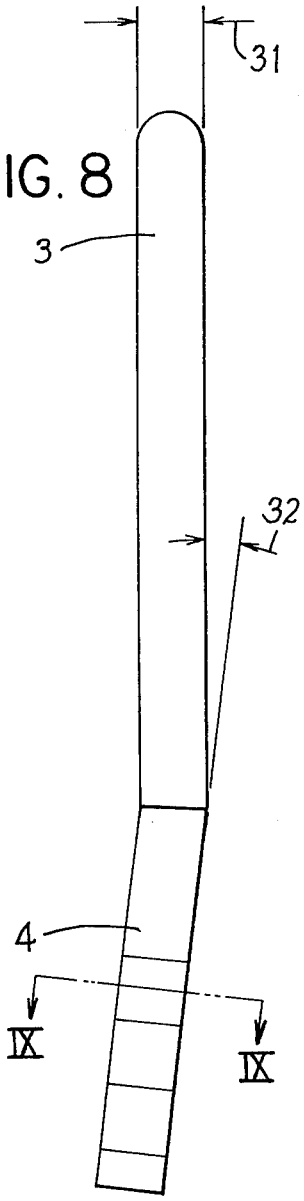
FIG.8 is a side view of the connecting member according to FIG. 6.
Figure 7:
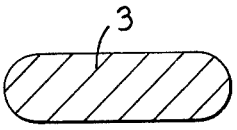
FIG. 7 is a sectional view taken along the line VII—VII of FIG. 6.
Figure 9:
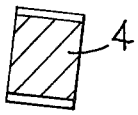
FIG. 9 is a sectional view taken along the line IX—IX of FIG. 8.

The side edges 14 of the body of the connecting member 2 each define a small angle, preferably 2°, with respect to the longitudinal axis of the connecting member 2, as shown at 25 (FIG. 6), and these converge upwardly. The serrations on the extension 4 each have an inclined guide surface 15 thereon which is arranged at a small angle, preferably 15°, with respect to the longitudinal axis of the extension 4, as shown at 27, and have a retaining surface 16 which faces upwardly toward the body of the connecting member 2. The guide surfaces 15 facilitate insertion of the extension 4 into an opening provided in the end of the stem 1 and the retaining surfaces 16 thereafter cooperate with the sides of the opening in the stem 1 to resist separation of the connecting member 2 and the stem 1. The extension 4 is arranged at a small angle, preferably 7°, with respect to the plane of the connecting member 2, as shown in FIG. 8 at 32. Referring to FIGS. 6 and 8, the dimensions 24, 26, 28, 29 and 31 preferably have respective tolerances of +0.0, −0.05 mm; +0.0, −0.05 mm; +0.1, −0.0 mm; +0.0, −0.05 mm; and +0.0, −0.02 mm.

Figure 10:
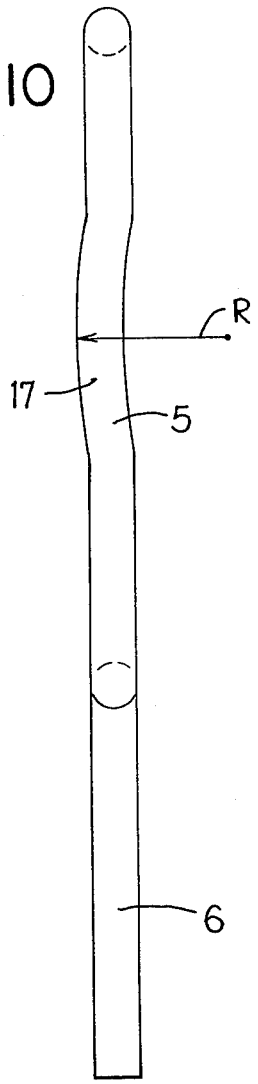
FIG. 10 is a side view of an alternative embodiment of the connecting member of FIG. 6 which is of springy design and shaped to provide a secure connection between the handle and a brush head.
Figure 11:
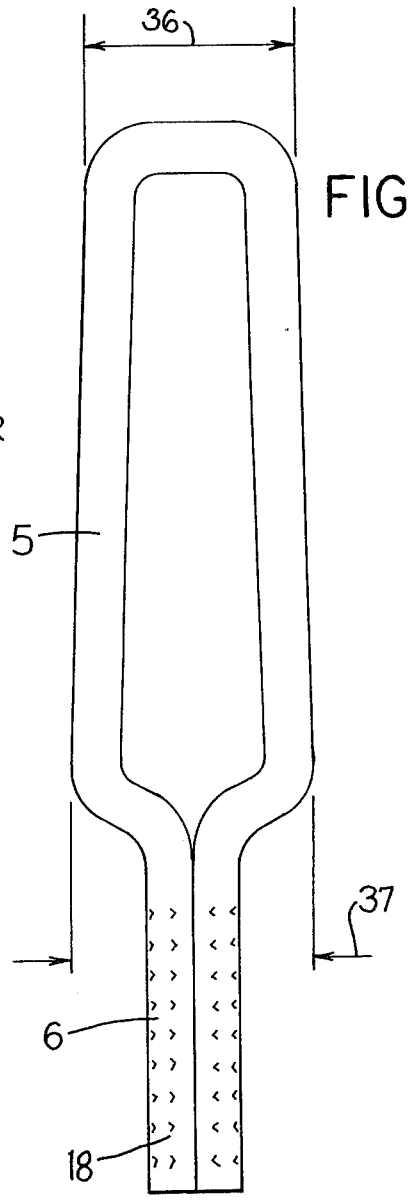
FIG. 11 is a front view of the connecting member of FIG. 10.

FIGS. 10 and 11 illustrate, for a composite construction of the handle, such as a plastic stem and a metal connecting member, a springy metallic connecting member 5 made of spring wire which is bent to the illustrated shape. An offset portion 17 having a radius R is provided to ensure a secure fit between the handle and brush head. The connecting adjacent ends of the wire defining the connecting member 5 are embedded in the plastic handle during assembly and have spurs or ribs 18 thereon which project outwardly approximately 0.3 mm from the wire surface.

Referring to FIGS. 10 and 11, the dimensions 36 and 37 each preferably have tolerances of +0.0, −0.05 mm. When the connecting member 5 is pressed into a cavity provided in a brush head, the offset portion 17 is resiliently bent away from its initial position a small amount by a wall of the cavity, and thereafter presses firmly against the wall of the cavity to securely retain the brush head on the connecting member 5.

Figure 12:
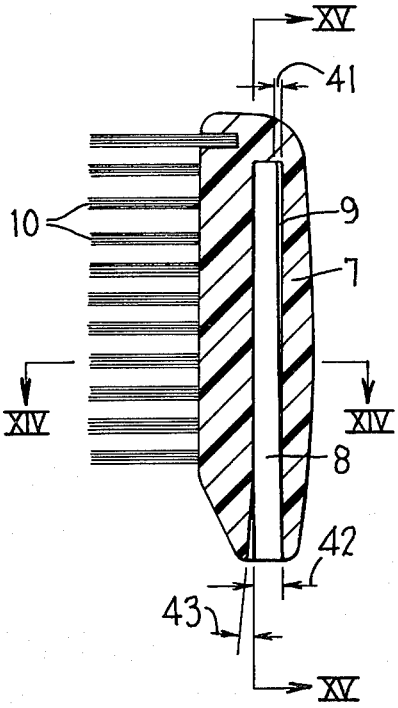
FIG. 12 is a sectional view of a brush head taken along the line XII—XII of FIG. 13.
Figure 13:
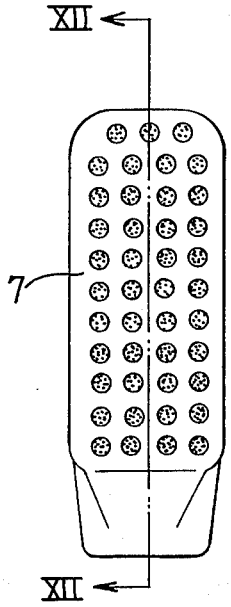
FIG. 13 is a front view of the brush head of FIG. 12.

FIGS. 12 to 15 illustrate a brush head according to the invention. FIG. 12 shows a cross section of the brush head, which includes a plastic head piece 7 having a recess or cavity 8 therein which receives the connecting member 2 of the handle. Furthermore, a wedge shaped ridge 9 is provided for rectilinearly guiding the brush head as it is moved onto the connecting member 2. The bristles 10 of the brush head are illustrated in an advantageous arrangement.

Figure 14:
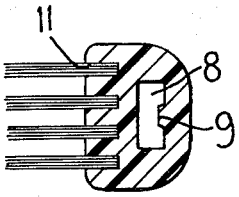
FIG. 14 is a sectional view taken along the line XIV—XIV of FIG. 12.
Figure 15:
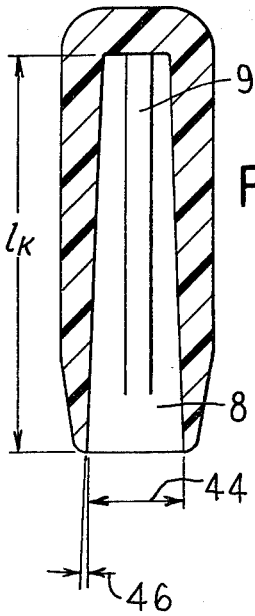
FIG. 15 is a sectional view taken along the line XV—XV of FIG. 12.

FIGS. 14 and 15 are cross sectional views of the brush head, and illustrate the cavity 8 and wedge shaped ridge 9. The sectional view of FIG. 14 also shows the holes 11 in which the bunches of bristles 10 are embedded. The cavity depth $l_k$ (FIG. 15) is greater than the length of the body of the connecting member 2 on the handle, thereby leaving a small space at the inner end of the cavity for solids, for example tooth paste deposits.

The wedge shaped ridge 9 preferably has a length less than the depth $l_k$ of the cavity and preferably has a height 41 of about 0.3 mm adjacent the inner end of the cavity 8. Referring to FIGS. 12 and 15, the width dimensions 42 and 44 of the cavity 8 each preferably have tolerances of +0.0, −0.05 mm. As shown in FIG. 12, the lower end of the cavity 8 is flared slightly, the angle 43 of the flare preferably being 4°, and as shown in FIG. 15, the side walls of the cavity 8 converge toward the inner end thereof, each being inclined at a small angle 46, preferably 2°, with respect to the longitudinal axis of the brush head.

The above discussion and the illustrated embodiments relate to a composite type of construction, such as plastic and metal, for a toothbrush with the characteristics of the invention, in which the metallic connecting member 3 or 5 (FIGS 6 and 10, respectively) is embedded in the plastic stem 1. This type of construction of a multiple part toothbrush provides, particularly in view of the need for optimum dental cleaning effect of the teeth of a user, great advantages in comparison with conventional toothbrushes, particularly toothbrushes which are not of multi-part construction since by changing the orientation of the changeable brush head on the connecting member having the fixed, longitudinal dihedral angle 32, the creation of two differently oriented contact surfaces between the bristles of one brush head and the surface of the teeth of a user is made possible for a given position of the handle. This longitudinal dihedral angle in the stem is preferably 7°.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A toothbrush, comprising a handle and a brush head, said handle including an elongate stem and an elongate generally flat connecting member of substantially uniform thickness which is supported on said stem at one end thereof, which extends away from said one end of said stem at a small acute angle with respect to said stem, and which is generally wedge shaped and tapers toward its outer end, said brush head including a headpiece, means defining an elongate cavity in said headpiece which is generally wedge shaped and tapers inwardly, and a plurality of bristles which each have one end supported on and which project outwardly from said headpiece, said cavity being adapted to receive said connecting member snugly and removably therein in two different orientations which respectively correspond to first and second positions of said brush head relative to said stem and in which said bristles project in respective, approximately opposite directions relative to said stem, the outer ends of said bristles substantially defining a plane and said stem forming an angle of substantially 7° with respect to said plane when said brush head is in said first position and an angle of substantially −7° with respect to said plane when said brush head is in said second position, said generally flat connecting member and said cavity both being substantially parallel to said plane of the outer ends of said bristles.

2. The toothbrush according to claim 1, wherein said handle is constructed in one piece and is made of metal, said stem thereof being hollow.

3. The toothbrush according to claim 1, wherein, said stem is made of plastic and said connecting member is made of metal and is rigid, said connecting member having a serrated extension thereon which is embedded in said plastic stem.

4. The toothbrush according to claim 1, wherein said stem and said connecting member are made of different materials, said stem being a springy, metallic member.

5. The toothbrush according to claim 4, wherein said connecting member is made of a bent wire and has a curved offset portion.

6. The toothbrush according to claim 5, wherein said wire has ends which are adjacent, which are embedded in said stem, and which have means defining outwardly projecting spurs thereon for facilitating a secure and fixed retention of said ends of said wire in said stem, said spurs projecting outwardly from the surface of said wire a distance of up to 0.3 mm.

7. The toothbrush according to claim 1, wherein said cavity extends into said brush head a distance greater than the distance said connecting member extends outwardly away from said stem.

8. The toothbrush according to claim 1, wherein said cavity in said headpiece has on a wall thereof a wedge shaped ridge which has a maximum height in the region of the inner end of said cavity, said maximum height of said ridge being less than or equal to 0.3 mm and said ridge being shorter in length than said cavity.

9. The toothbrush according to claim 3, wherein said connecting member has a width tolerance of −0.05 mm and a thickness tolerance of −0.02 mm, and the serrations on said extension have a length tolerance of +0.1 mm.

10. The toothbrush according to claim 4, wherein said connecting member has a width tolerance of −0.05 mm and said cavity in said brush head has a width tolerance of −0.05 mm.

11. A toothbrush, comprising a handle and a brush head; wherein said handle includes an elongate stem which is made of a plastic material and has means defining a longitudinally extending opening in one end thereof, and includes an elongate connecting member having an elongate body and an elongate extension on one end of said body, said extension having a plurality of saw-tooth shaped, outwardly projecting serrations thereon and being fixedly held in said opening in said stem, said connecting member being an elongate platelike metal member and said body and said extension of said connecting member being respective portions of said platelike metal member, said platelike metal member being bent in the region of the intersection of said body and said extension so that said body and said extension form a dihedral angle of substantially 7° with respect to each other and said body extends away from said one end of said stem at an angle of substantially 7° with respect thereto, said body of said connecting member being generally wedge shaped and having side edges which converge toward the outer end thereof at a small acute angle with respect to each other; and wherein said brush head includes a headpiece made of a plastic material, means defining an elongate cavity in said head-piece, and a plurality of bristles which each have one end supported on said headpiece and which project outwardly from said headpiece in a direction approximately perpendicular to said cavity therein, the length of said cavity in said headpiece being greater than the length of said body of said connecting member, said cavity being generally wedge shaped and having two side walls which converge toward the inner end thereof substantially at said small acute angle with respect to each other, and said cavity having on a further wall thereof a wedge shaped ridge which extends lengthwise of said cavity and has a maximum height in the region of the inner end of said cavity, said cavity being adapted to receive said body of said connecting member snugly and removably therein in two different orientations which respectively correspond to first and second positions of said brush head relative to said stem and in which said bristles project in respective, approximately opposite directions relative to said stem, the outer ends of said bristles substantially defining a plane and said stem forming an angle of substantially 7° with respect to said plane when said brush head is in said first position and forming an angle of substantially −7° with respect to said plane when said brush head is in said second position.

* * * * *